US007011550B1

(12) United States Patent
Lai et al.

(10) Patent No.: US 7,011,550 B1
(45) Date of Patent: Mar. 14, 2006

(54) COMPOUND ELECTRICAL CONNECTOR

(75) Inventors: Ming Chun Lai, Tucheng (TW); Jizu Luo, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/073,642

(22) Filed: Mar. 8, 2005

(51) Int. Cl.
*H01R 25/00* (2006.01)

(52) U.S. Cl. ..... 439/638

(58) Field of Classification Search ..... 439/638, 439/639
See application file for complete search history.

(56) References Cited

U.S. PATENT DOCUMENTS 5,411,416 A * 5/1995 Balon et al. ..... 439/639
5,807,140 A * 9/1998 Hopkins ..... 439/638
5,812,683 A * 9/1998 Parker et al. ..... 439/638
6,193,655 B1 * 2/2001 McGrath ..... 439/638
6,213,815 B1 * 4/2001 Wu ..... 439/638
6,626,703 B1 * 9/2003 Hsin ..... 439/638

* cited by examiner

*Primary Examiner*—Tho D. Ta
(74) *Attorney, Agent, or Firm*—Rosenberg, Klein & Lee

(57) ABSTRACT

The present invention provides a compound electrical connector comprising a plug connector, an audio jack, a power jack and a radio frequency jack, together with a printed circuit board assembled in an insulation cover. The insulation cover has three cavities formed on one side thereof for receiving the three jacks respectively. Each of the audio jack, the power jack and the radio frequency jack has a contacting portion received respectively in one of the corresponding cavities of the insulation cover for contacting with complementary connectors and a soldering portion being soldered to a printed circuit board. The plug connector comprises a contacting portion protruded out from another side of the insulation cover for contacting with a complementary socket connector, and a soldering portion being soldered to the printed circuit board. Therefore, the compound electrical connector facilitates installing the jacks with different functions connector to an electronic device and saves space in the electronic device.

5 Claims, 5 Drawing Sheets

COMPOUND ELECTRICAL CONNECTOR

BACKGROUND OF THE INVENTION

1. Field of the Invention

The present invention relates generally to a compound electrical connector, and more especially to a compound electrical connector capable of integrating a plug connector, an audio jack, a power jack and a radio frequency (RF) jack with an insulation cover.

2. The Related Art

With the development of variety of electronic peripheral devices, the transmission interface is achieved by various means. Therefore, various electrical connectors having different structures and functions are employed widely as transmission interfaces for satisfying various needs of different hardware devices. In general, electrical connectors are mounted individually on the edge of a printed circuit board (PCB) in an electronic device, and arranged in juxtaposed or parallel manner. However, the arrangement of the electrical connectors occupies too much inner space of the electronic device, and brings some hindrance to the miniaturization of the electronic device. Moreover, it is time-consuming and complicated to individually mount more than one electrical connector on the PCB of the electronic device. The existing defects as described above have also been shown in the following specific example.

Generally, a common consuming electronic device is equipped with three types of electrical connectors in which a power jack is provided as a power signal transmission interface, an audio jack is provided as an audio signal transmission interface and a radio frequency jack is provided as a RF signal transmission interface. When the electrical connectors as mentioned above are assembled with a motherboard of the electronic device individually, it should be considered whether the capacity of the electronic device is enough for holding the electrical connectors, together with consideration of fitness between the shapes of the electronic device and the electrical connectors. So, it brings much inconveniences and restrictions to assembly manipulation.

SUMMARY OF THE INVENTION

Thus, an object of the present invention is to provide a compound electrical connector, which has a plurality of connectors with different functions being combined as an integrated connector, thus to facilitate installing the connectors with different functions to an electronic device and to save space in the electronic device.

To attain the object above, the present invention is to provide a compound electrical connector comprising an insulation cover with three cavities being defined on at least one side thereof and defined respectively as the first cavity, the second cavity and the third cavity, a plug connector, an audio jack, a power jack and a radio frequency jack. The plug connector positioned in the insulation cover includes a first contacting portion and a first soldering portion. The first contacting portion protrudes out from another side of the insulation cover for mating with a complementary connector. The audio jack positioned in the insulation cover includes a second contacting portion and a second soldering portion disposed in the first cavity. The power jack positioned in the insulation cover comprises a third contacting portion and a third soldering portion disposed in the second cavity. The radio frequency jack positioned in the insulation cover comprises a fourth contacting portion and a fourth soldering portion which is positioned in the third cavity. The soldering portions of the plug connector, the audio jack, the power jack and the radio frequency jack are all soldered on a printed circuit board.

According to another aspect of this invention, the first contacting portion of the plug connector comprises a metal cover with a receiving space formed in the metal cover, and an insulation spacer received in the receiving space. A terminal receptacle and an assembly cavity formed in juxtaposed manner on the insulation spacer, in which a plurality of terminals is arranged on two opposite sides of the terminal receptacle, and a radio frequency plug is disposed in the assembly cavity.

In the present invention, the audio jack, the power jack and the radio frequency jack are integrated in the compound electrical connector for facilitating installing the different connectors to an electronic device. Additionally, the compound electrical connector saves the space in the electronic device.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
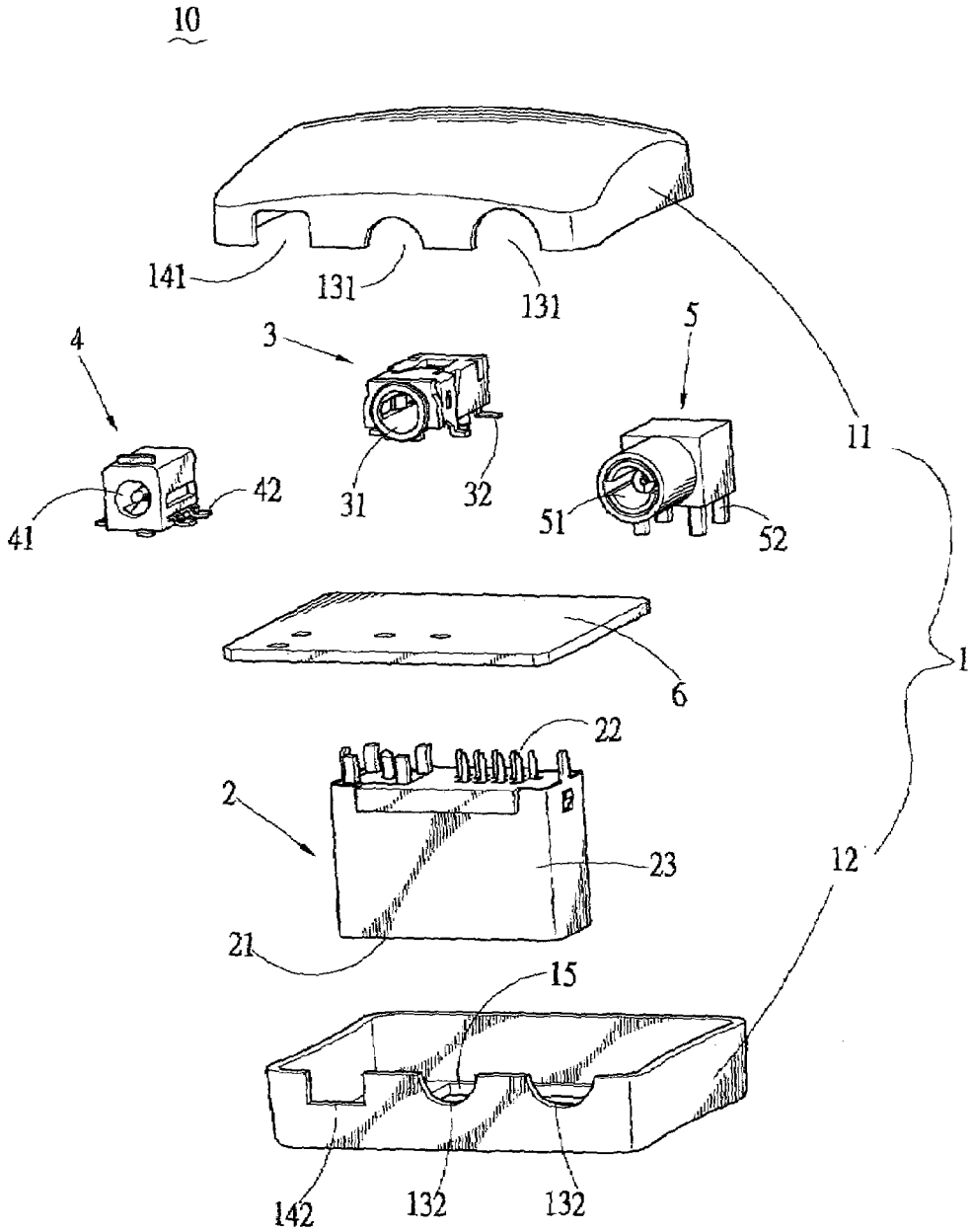
FIG. 1 is an exploded perspective view of a compound electrical connector according to the present invention.
Figure 3:
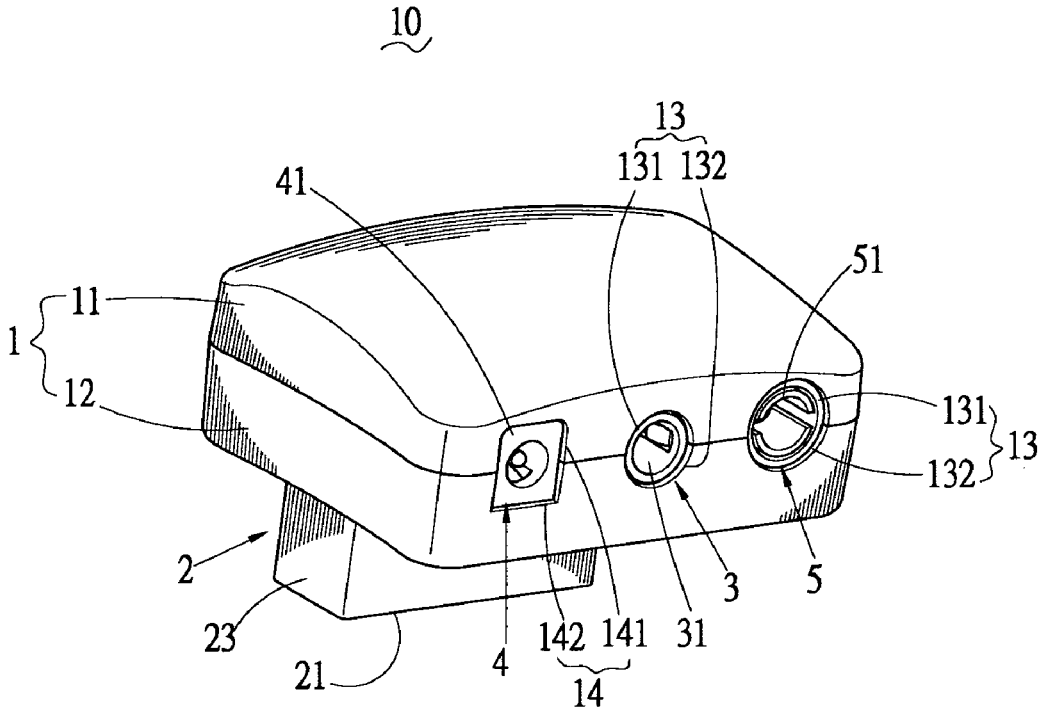
FIG. 3 is a perspective view of the compound electrical connector as shown in FIG. 1.

Referring to FIGS. 1 and 3, a compound electrical connector 10 comprises an insulation cover 1. The insulation cover 1 includes an upper cover 11 and a lower cover 12. The upper and lower covers 11, 12 are assembled to be the insulation cover 1 by means of ultrasonic soldering. A cutout 15 is defined on the bottom surface of the lower cover 12. The insulation cover 1 further has three cavities 13, 14 formed on one lateral side thereof, in which two cavities 13 are circular and defined respectively as the first cavity and the third cavity, another cavity 14 is square and defined as the second cavity (as shown in FIG. 3). Each of the two circular cavities 13 consists of a pair of semicircular notches 131, 132 disposed respectively on the upper cover 11 and the lower cover 12 and in symmetric configuration. The square cavity 14 consists of a pair of rectangular notches 141, 142 disposed respectively on the upper cover 11 and the lower cover 12 and in symmetric configuration. According to the preferred embodiment, the semicircular notches 131, 132 and the rectangular notches 141, 142 on the same of the upper and lower cover 11, 12 are arranged in a row. According to the preferred embodiment, the three cavities 13, 14 are provided respectively to receive three electrical connectors 3, 4, 5 with different functions, and the detail will be described below.

According to the present invention, the compound electrical connector 10 further comprises a plug connector 2, an audio jack 3, a power jack 4 and a radio frequency jack 5, together with a printed circuit board (PCB) 6 assembled in the insulation cover 1. The plug connector 2 includes a first contacting portion 21 passing through the cutout 15 and extending out from the bottom surface of the insulation cover 1, and a first soldering portion 22 connected with the first contacting portion 21 and soldered on the PCB 6. The audio jack 3 includes a second contacting portion 31 positioned in the first cavity 13 and a second soldering portion 32 connected with the second contacting portion 31. The power jack 4 includes a third contacting portion 41 positioned in the second cavity 14, and a third soldering portion 42 connected with the third contacting portion 41. The radio frequency jack 5 includes a fourth contacting portion 51 positioned in the third cavity 13, and a fourth soldering portion 52 connected with the fourth contacting portion 51. All the soldering portion 32, 42, 52 of the three jacks 3, 4, 5 are soldered to the PCB 6 for the corresponding jacks 3, 4, 5 communicating respectively with the plug connector 2.

Figure 2:
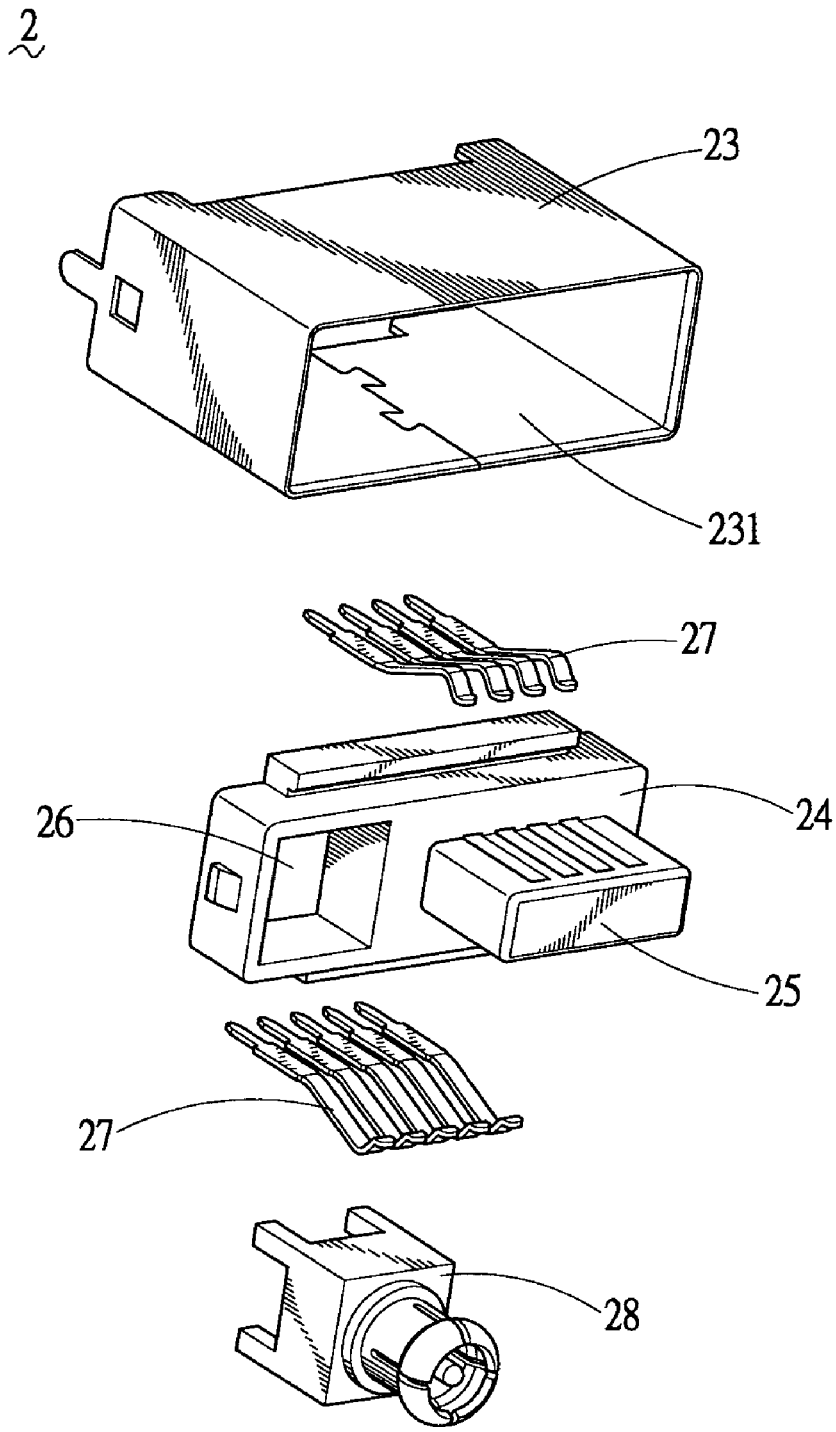
FIG. 2 is an exploded perspective view of a plug connector of the compound electrical connector as shown in FIG. 1.
Figure 4:
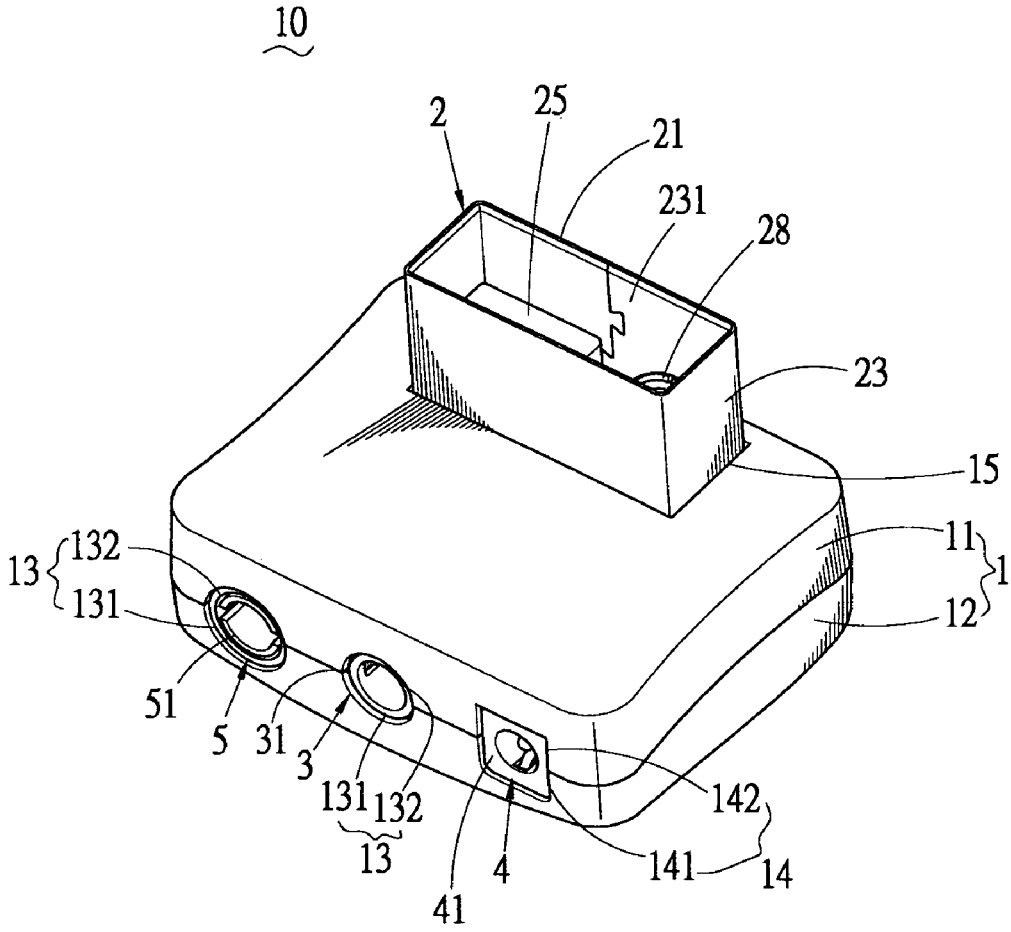
FIG. 4 is another perspective view of the compound electrical connector as shown in FIG. 1.

Now referring to FIGS. 2 and 4, the first contacting portion of the plug connector 2 further comprises a metal cover 23 and an insulation spacer 24 being disposed in the metal cover 23. The metal cover 23 defines a receiving space 231 and the insulation spacer 24 is disposed in the receiving space 231. A rectangle terminal receptacle 25 is disposed on the insulation spacer 24 and an assembly cavity 26 is defined in the housing member 24 adjacent to the terminal receptacle 25 in juxtaposed arrangement. A plurality of terminals 27 is arranged on two opposite sides of the rectangular terminal receptacle 25 to transmit audio signals from/to the audio jack 3 and to transmit power signals from/to the power jack 4. A radio frequency plug 28 is positioned in the assembly cavity 26 to transmit radio frequency signals from/to the radio frequency jack 5.

Please referring to FIGS. 3 and 4 again, when the compound electrical connector 10 is assembled, the plug connector 2, the audio jack 3, the power jack 4 and the radio frequency jack 5 are all soldered on the PCB 6. Then the upper cover 11 and lower cover 12 are assembled with each other to be the insulation cover 1, and the electrical connectors 2, 3, 4, 5 together with the PCB 6 are positioned in the insulation cover 1. At this time, the first contacting portion 21 of the plug connector 2 passes through the cutout 15 and protrudes outwardly from the lower cover 12. The semicircular notches 131,132 and the rectangular notches 141,142 of the upper and lower cover 11, 12 are correspondingly matched with each other to be the two circular cavities 13 and the square cavity 14, while the contacting portions 31, 41, 51 of the three jacks are respectively received in the corresponding the cavities 13, 14 of the insulation cover 1. Thus, the compound electrical connector 10 is assembled completely.

Figure 5:
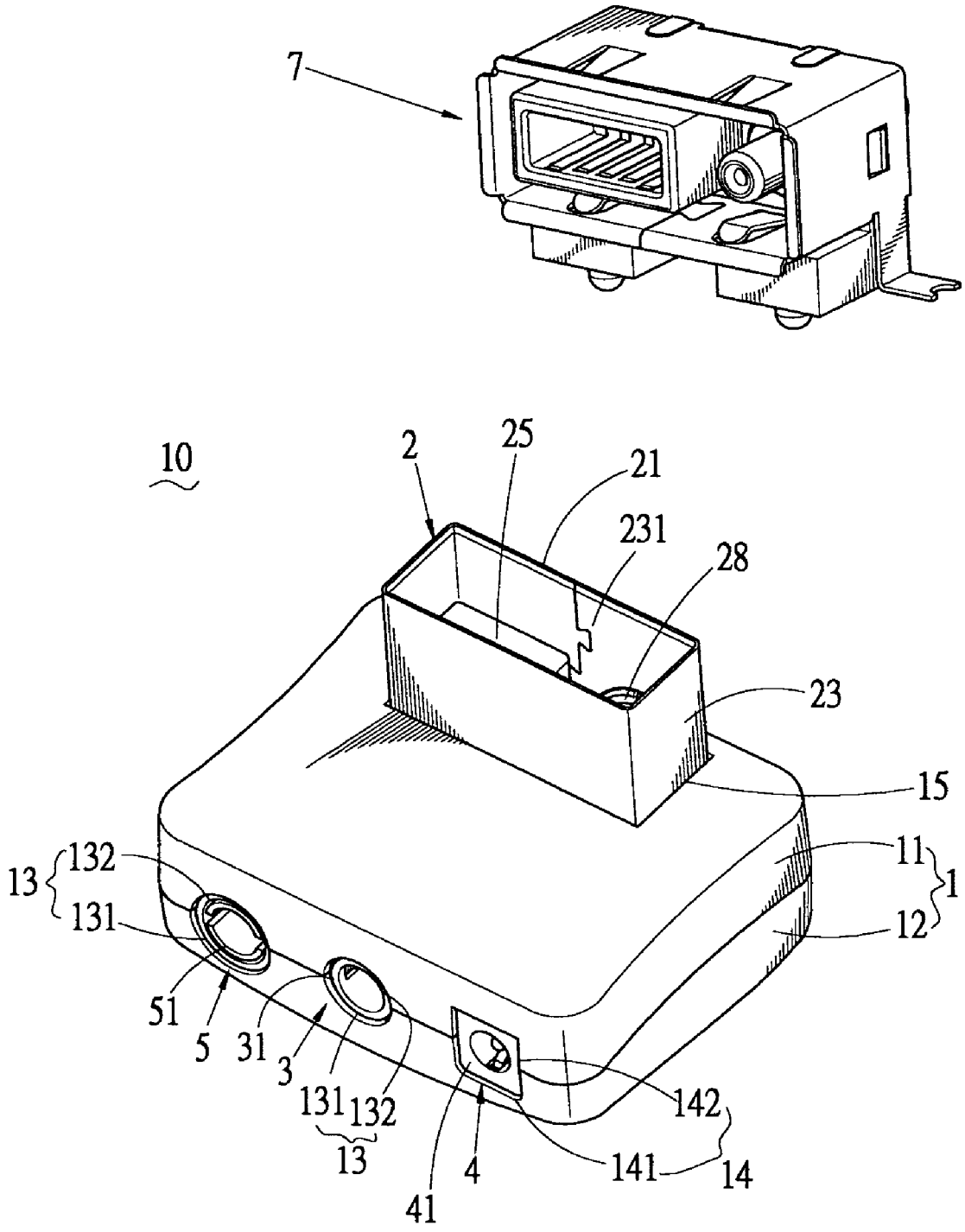
FIG. 5 is a perspective view showing the compound electrical connector and a complementary socket connector.

Referring to FIG. 5, according to the present invention, the compound electrical connector 10 is connected with a complementary socket connector 7. Therefore, audio signals, power signals and radio frequency signals are transmitted respectively from the three jacks 3, 4, 5 to the complementary socket connector 7 via the plug connector 2, and vice versa, the signals are transmitted from the socket connector 7 to the plug connector 2, and are further transmitted to the corresponding jacks 3, 4, 5.

As mentioned above, the electrical connectors 2, 3, 4, 5 with different functions are combined to be an integrated connector. As a result, it is convenient to install the compound connector 10 with different function connectors 2, 3, 4, 5 to an electronic device. Moreover, it saves space in the electronic device and satisfies the demand for miniaturization of electronic products.

Although a particular embodiment of the present invention has been described in detail for purposes of illustration, variations and modifications to the embodiment disclosed herein, may be devised that are within the spirit of the invention and the scope of the claims.

What is claimed is:

1. A compound electrical connector comprising:

an insulation cover, having three cavities formed on at least one side thereof and defined respectively as the first cavity, the second cavity and the third cavity;

a plug connector, positioned in the insulation cover and comprising a first contacting portion and a first soldering portion, with the first contacting portion protruding out from another side of said insulation cover for making connection with a complementary socket connector, the first contacting portion of said plug connector including (a) a metal cover with a receiving space formed in the metal cover, (b) an insulation spacer received in the receiving space formed in the metal cover, and (c) an insulation spacer received in the receiving space, with a terminal receptacle and an assembly cavity formed in juxtaposed manner on the insulation spacer, a plurality of terminals being arranged on two opposite sides of the terminal receptacle, and a radio frequency plug being disposed in the assembly cavity;

an audio jack positioned in the insulation cover and comprising a second contacting portion and a second soldering portion, with the second contacting portion being positioned in the first cavity;

a power jack positioned in the insulation cover and comprising a third contacting portion and a third soldering portion, with the third contacting portion being positioned in the second cavity; and a radio frequency jack positioned in the insulation cover and comprising a fourth contacting portion and a fourth soldering portion, the fourth contacting portion being positioned in the third cavity;

wherein the soldering portions of the plug connector, the audio jack, the power jack and the radio frequency jack are all soldered to a printed circuit board.

2. The compound electrical connector as claimed in claim 1, wherein said insulation cover consists of an upper cover and a lower cover engaged to the upper cover.

3. The compound electrical connector as claimed in claim 2, wherein both the first and third cavities in said insulation cover for receiving the audio jack and radio frequency jack are circular, in which each of the first and third cavities consists of two semicircular notches defined respectively on the upper and lower covers.

4. The compound electrical connector as claimed in claim 2, wherein the second cavity in said insulation cover for receiving the power jack is square, which consists of two rectangular notches defined respectively on the upper and lower covers.

5. The compound electrical connector as claimed in claim 2, wherein a cutout is defined in the lower cover, and said plug connector protrudes outwardly from the cutout.

* * * * *